US006760018B1

(12) United States Patent
Takahashi

(10) Patent No.: US 6,760,018 B1
(45) Date of Patent: Jul. 6, 2004

(54) CIRCUIT AND METHOD FOR DRIVING LIQUID CRYSTAL DISPLAY DEVICE

(75) Inventor: Kenichi Takahashi, Saitama (JP)

(73) Assignee: Citizen Watch Co., Ltd., Tokyo (JP)

( * ) Notice: Subject to any disclaimer, the term of this patent is extended or adjusted under 35 U.S.C. 154(b) by 0 days.

(21) Appl. No.: 09/155,641

(22) PCT Filed: Feb. 26, 1998

(86) PCT No.: PCT/JP98/00770

§ 371 (c)(1),
(2), (4) Date: Feb. 3, 1999

(87) PCT Pub. No.: WO98/38626

PCT Pub. Date: Sep. 3, 1998

(30) Foreign Application Priority Data

Feb. 27, 1997 (JP) ..... 9-43329

(51) Int. Cl.[7] ..... G09G 5/00

(52) U.S. Cl. ..... 345/211; 345/94; 345/95; 345/210; 345/100; 345/98

(58) Field of Search ..... 345/98, 100, 94, 345/211, 95, 210

(56) References Cited

U.S. PATENT DOCUMENTS 5,559,526 A * 9/1996 Izawa ..... 345/96
5,578,957 A * 11/1996 Erhart et al. ..... 327/333
5,627,556 A * 5/1997 Kwon et al. ..... 345/76
5,650,801 A * 7/1997 Higashi ..... 345/210
5,714,844 A * 2/1998 Sato ..... 315/169.4
5,838,287 A * 11/1998 Kuijk ..... 345/58
5,870,071 A * 2/1999 Kawahata ..... 345/100
6,064,361 A * 5/2000 Akiyama ..... 345/98
6,067,064 A * 5/2000 Furuhashi et al. ..... 345/89
6,118,425 A * 9/2000 Kudo et al. ..... 345/100

FOREIGN PATENT DOCUMENTS

JP 7-334122 A 12/1995

* cited by examiner

*Primary Examiner*—Xiao Wu
*Assistant Examiner*—Kevin Nguyen
(74) *Attorney, Agent, or Firm*—Birch, Stewart, Kolasch & Birch, LLP

(57) ABSTRACT

A liquid-crystal display, which is driven by a voltage swinging method achieves reduction in size and reduced power consumption. The liquid-crystal display has a circuit configuration that enables direct input of a signal that has controller potential. This reduces the logic voltage within scanning electrode drivers of the structure of the liquid-crystal display.

1 Claim, 6 Drawing Sheets

(A)

(B)

CIRCUIT AND METHOD FOR DRIVING LIQUID CRYSTAL DISPLAY DEVICE

This application is the national phase under 35 U.S.C. §371 of prior PCT International Application No. PCT/JP98/00770 which has an International filing date of Feb. 26, 1998 which designated the United States of America, the entire contents of which are hereby incorporated by reference.

FIELD OF THE INVENTION

The present invention relates to a matrix-type liquid-crystal display apparatus (hereinafter referred to as an liquid-crystal display), and more specifically it relates to a scanning electrode drive apparatus which drives a liquid-crystal display and a method of drive associated therewith.

BACKGROUND ART

In recent years, with advances in information-oriented societies, liquid-crystal displays have come into use in a wide range of fields, such as in TVs and in office equipment. In compact portable equipment in particular, liquid-crystal displays have come into overwhelming widespread use, compared with other types of displays.

In these types of fields, because of the high importance of portability, while compactness is demanded, a larger screen is required to assure readability. For this reason, there is a great need to increase the display region within a limited area, this being accompanied by an ever-narrowing area surrounding the liquid-crystal display.

One method to cope with accommodating narrowed area surrounding the display is to slim-down and make small the scanning electrode drive device and signal electrode drive device, and one method of achieving a slimmed-down and smaller scanning electrode drive device and signal electrode drive device is to make the withstand voltage small so as to shrink the element size.

In the method used in the past, as shown in FIG. 4, was to change the potential when the liquid-crystal display operates by AC, the scanning electrode device outputting the combinations of V1/V2 and V3/V4, the signal electrode drive device outputting the combinations of V5/V4 and V1/V6 at those respective times.

Therefore, for both the scanning electrode drive device and the signal electrode drive device, a withstand voltage of at least V1–V4 was required, making it necessary to use an electrode drive device with a high withstand voltage.

In this method, it is necessary to implement the signal electrode drive device as well using elements having a high withstand voltage, this being incompatible with the achievement of compactness and high density.

This is also disadvantageous and not compatible with an increase in the speed of operation of the signal electrode scanning device accompanying an increase in the number of data signals that are required for an increased number of pixels.

Additionally, because a high voltage must be operated at high speed, the associated power consumption is not very low.

One method of solving the above-noted problems is to use a drive method which makes use of power supply voltage swinging method.

This power supply voltage swinging method is that method whereby, as shown in FIG. 5, a potential VB which is switched from potential VA, as grounding potential, is input to the scanning electrode drive device, while in synchronization with which, a potential VD which is switched from potential VC, as high level voltage potential, is also input to the scanning electrode drive device, respectively.

By doing this, it is possible to greatly lower the withstand voltage of the signal electrode drive device without increasing the withstand voltage of the scanning electrode drive device, the result being that it is possible to achieve a increased operating speed in the signal electrode drive device due to an increase in the number of data signals, and also to achieve high density and low power consumption.

However, using the power supply undulation method, in the case in which a signal from an external system is input to the scanning electrode drive device, when the power supply potential is in the period A condition as shown in FIG. 5, within the scanning electrode drive device there is a low-level input when the input signal is at the VB level and a high-level input when the input signal is at the VD level. Also, when the power supply potential is in the period B condition, within the scanning electrode drive device there is a low-level input when the input signal is at the VA level and a high-level input when the input signal is at the VC level.

For this reason, in the case in which a signal is input from an external system, depending upon the condition of the power supply potential, it is necessary to input the VD level or the VC level in the case of inputting a high level, and necessary to input the VB level or the VA level in the case of inputting a low level.

For this reason, it is necessary to change the potential of an externally input signal, this making it necessary to have an external circuit that converts the input signal potential.

An example of a drive circuit of a liquid-crystal display which uses the above-noted power supply undulation method will now be described, with reference being made to FIG. 6.

Specifically, a drive circuit 200 for a liquid-crystal display which uses the power supply voltage swinging method (referred to the voltage swinging method hereafter) of the past has signal electrode drive circuits 203 that drive the signal electrodes of the liquid-crystal display 202 and scanning electrode driving circuits 204 that drive the scanning electrodes that are provided in a direction that perpendicularly intersects the above-noted signal electrode drive circuits.

More specifically, this drive circuit 200 has a swinging voltage generating circuit 206 that generates a swinging voltage and supplies this swinging voltage to the above-noted scanning electrode driving circuits 204, a level-converting circuit 207 that is connected to the above-noted swinging voltage generating circuit 206 and the above-noted scanning electrode driving circuits 204, that is connected to an input signal (sign), and that is provided for the purpose of converting this input signal, which is input via an appropriate signal input means 208, to the above-noted swinging voltage level, and a controller 205 that separately controls the above-noted signal electrode drive circuits 203, swinging voltage generating circuit 206, and level-converting circuit 207.

In the above-noted drive circuit for a liquid-crystal display that uses the voltage swinging method of the past, it is necessary to use an input signal such that coincides with the difference in potential between the high-level voltage (VDD) and the low-level voltage (VSS) output from the above-noted swinging voltage generating circuit 206.

Therefore, in a drive circuit for the liquid-crystal display of the past as described above, as shown in FIG. 7, the actual input signal (sign; indicated by a thick broken line in the drawing) is generated by voltage conversion so as to vary as shown by the thick line in the drawing (signV).

Therefore, in a drive circuit for a liquid-crystal display in the past, it is minimally required that the above-noted level-converting circuit 207 be provided, and there is the problem that this makes it difficult to achieve a downsizing of the overall drive circuit of this liquid-crystal display.

Additionally, as seen from the scanning electrode drive device, it is not necessary to have the overall circuit have a high withstand voltage, and on the contrary, it is desirable that in particular, a portion which processes controlling signals, other than output signals for driving a liquid crystal, is composed by devices having a low withstand voltage from the standpoint of low power consumption and compactness.

However, in the currently used configuration that employs the voltage swinging method, implementation using a low withstand voltage circuit is difficult.

An object of the present invention is to improve on the above-noted prior art, and to provide a circuit capable of direct input of an input signal the level of which is fixed, without shifting the level of the input signal while employing the voltage swinging method.

DISCLOSURE OF THE INVENTION

To achieve the above-noted object, the present invention employs the basic technical constitution described below. Specifically, a first aspect of the present invention is a liquid-crystal display drive circuit having a signal electrode driver which drives a plurality of signal electrodes and a scanning electrode driver which drives a plurality of scanning electrodes, an input signal from an external system being directly input to the scanning electrode drive device being driven, by a voltage swinging drive method.

In a second aspect of the present invention, a liquid-crystal display comprising a liquid-crystal display means, a signal electrode driving means which drives a plurality of a signal electrode that is connected to said liquid-crystal display means, and a scanning electrode driving means which drives a plurality of scanning electrode that is connected to said liquid-crystal display, a liquid-crystal display drive circuit minimally configured so that when driving each driving means using a voltage swinging drive method, an input signal from an external system is directly input to said scanning electrode driving means.

Additionally, a third aspect of the present invention is a liquid-crystal display driving method whereby, in a liquid-crystal display comprising a signal electrode driver which drives a plurality of signal electrodes and a scanning electrode driver which drives a plurality of scanning electrodes, a liquid-crystal display driving method whereby an input signal from an external system is directly input to said scanning electrode drivers which are driven by a voltage swinging drive method, so as to perform drive thereof.

A fourth aspect of the present invention is a liquid-crystal driving method used in a liquid-crystal display comprising a liquid-crystal display means, a signal electrode driving means which drives a plurality of signal electrode that is connected to said liquid-crystal display means, and a scanning electrode driving means which drives a plurality of scanning electrode that is connected to said liquid-crystal display, and the a liquid-crystal display driving method configured so as to convert a signal voltage level of an input signal from an external system to a low withstand voltage power supply potential level used within said scanning electrode driving means when driving each driving means using a voltage swinging drive method and so as to apply said converted level to said scanning electrode driving means.

SIMPLE DESCRIPTION OF THE DRAWINGS

PREFERRED EMBODIMENTS OF THE PRESENT INVENTION

Preferred embodiments of a liquid-crystal display drive circuit and driving method according to the present invention will be described, with reference being made to relevant accompanying drawings.

Specifically, in a liquid-crystal display having, for example, a signal electrode drive device that drives a plurality of signal electrode and a scanning electrode drive device that drives a plurality of scanning electrode, a liquid-crystal display drive circuit according to the present invention is capable of directly inputting a signal from an external system to the scanning electrode drive device to drive it by using the voltage swinging method.

That is, according to the above-noted configuration, without changing the potential of an input signal from an external system, and without adjusting the potential in the voltage swinging method by making a level shift, it is possible to input the signal directly to the scanning electrode drive device being driven using the voltage swinging method.

Figure 3:
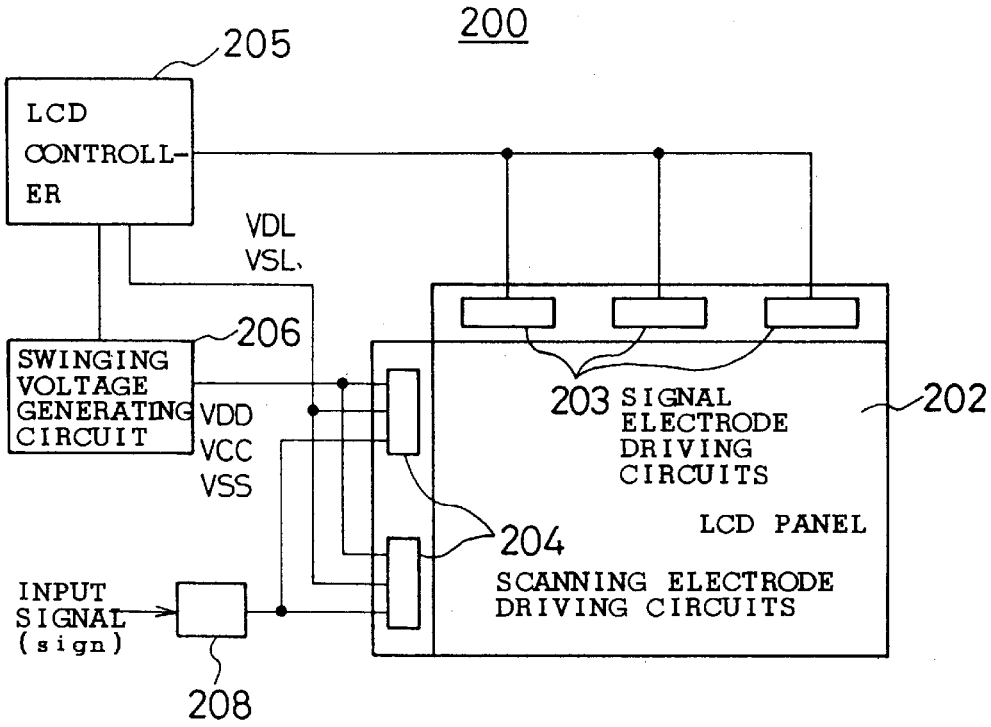
FIG. 3 is a block diagram which shows the configuration of an example of a liquid-crystal display drive circuit according to the present invention.
Figure 4:
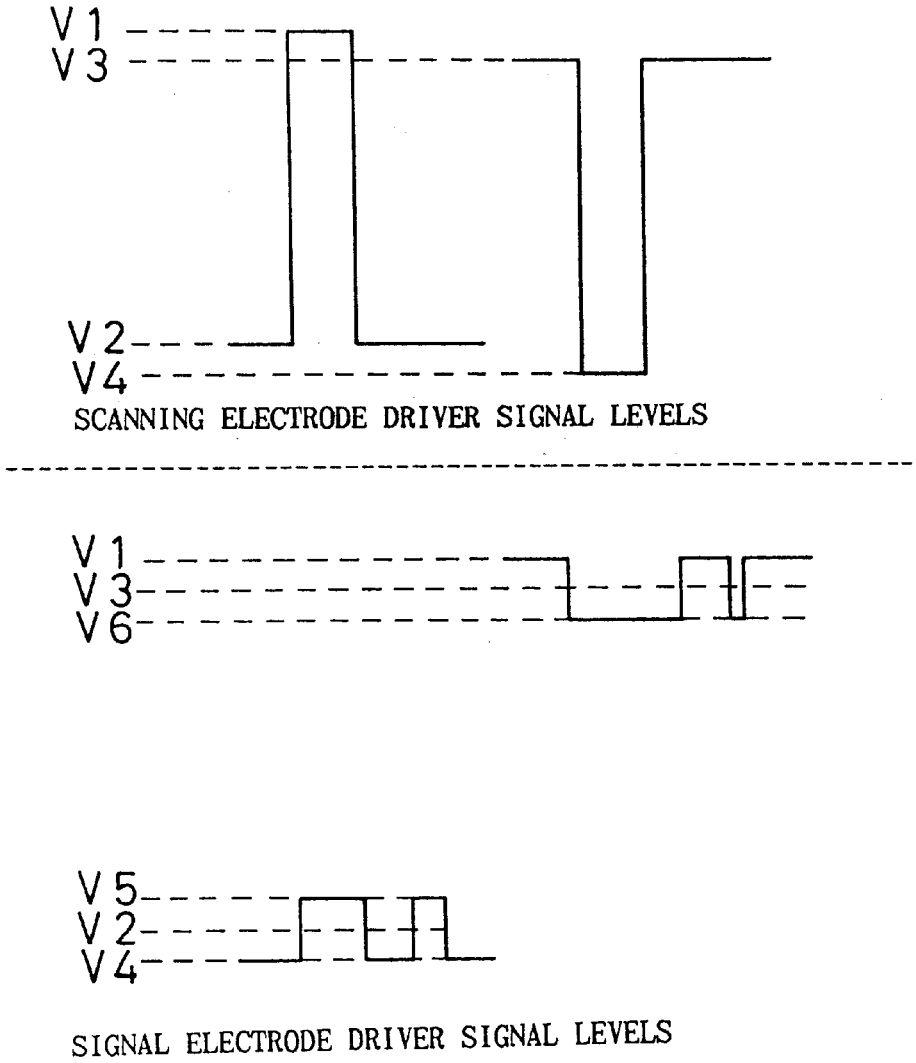
FIG. 4 is a drawing which shows the power supply potential in the prior art.
Figure 5:
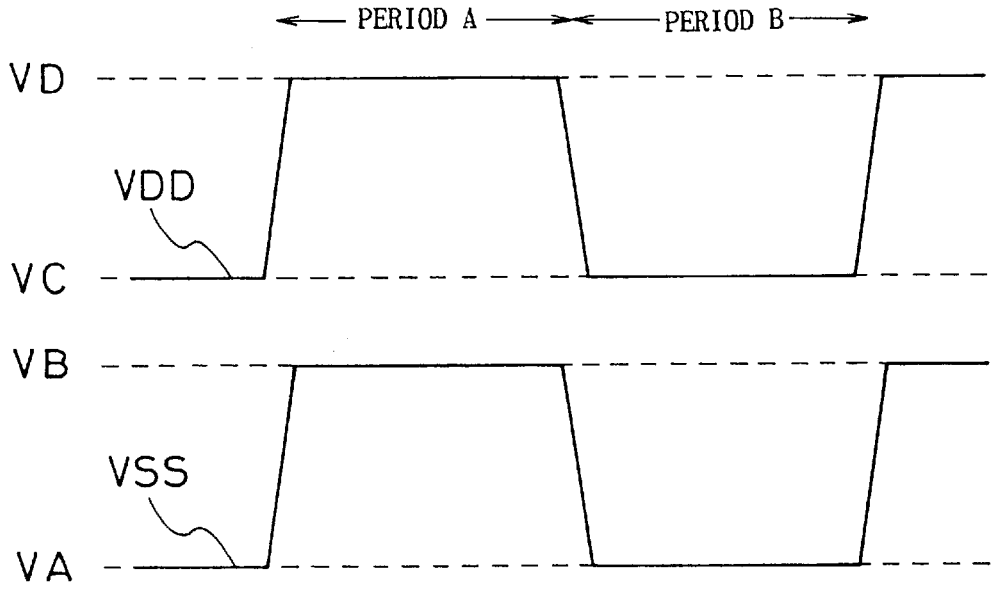
FIG. 5 is a drawing which shows the power supply potential in the voltage swinging method in the prior art.
Figure 6:
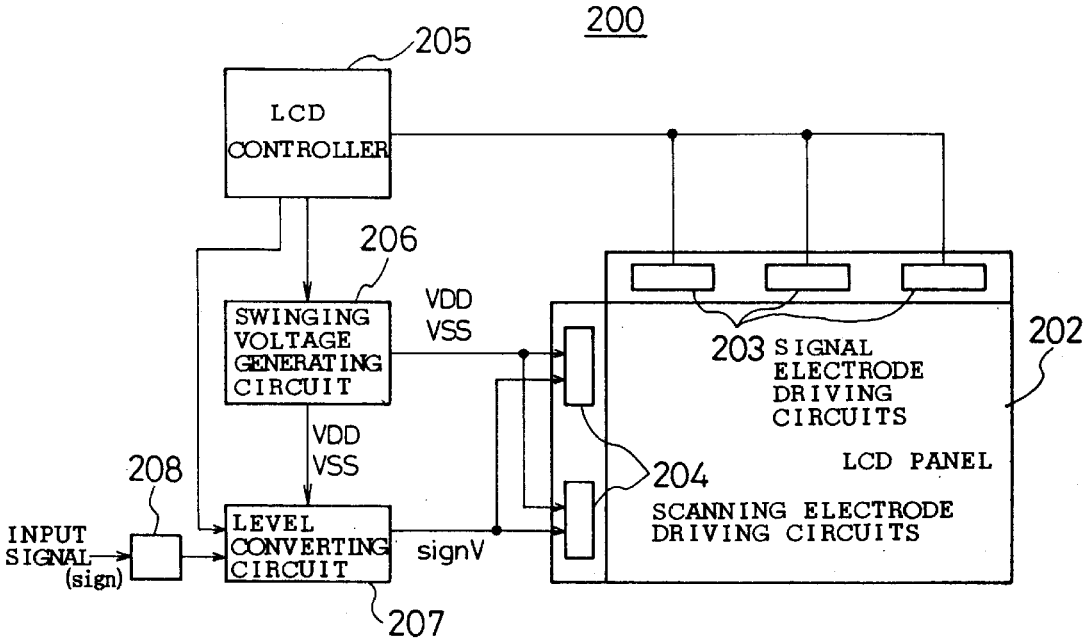
FIG. 6 is a block diagram which shows an example of the configuration of a liquid-crystal display drive circuit of the prior art which uses the voltage swinging method.
Figure 7:
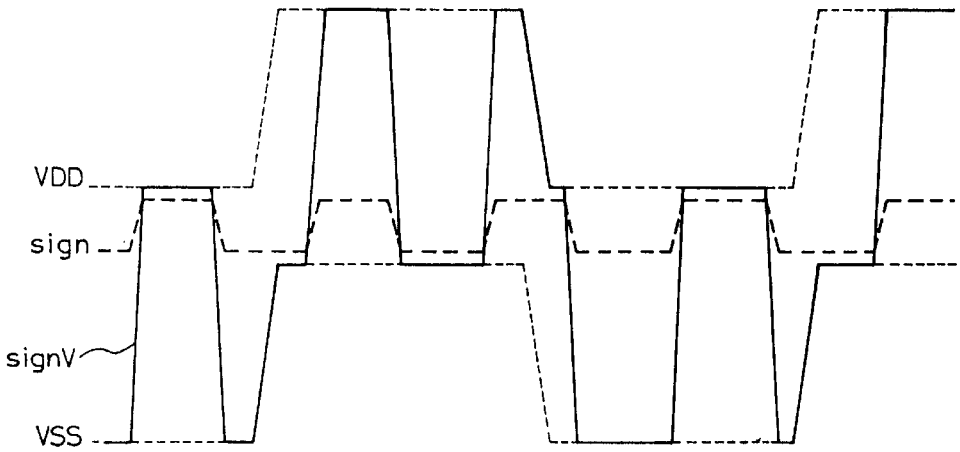
FIG. 7 is a drawing which shows an example of the voltage level of an input signal in the voltage swinging method of the prior art.

By way of detailed description of the liquid-crystal display drive circuit 200 of the present invention, which is shown in FIG. 3, in a drive circuit of liquid-crystal display 200 (LCD panel), which is formed by, for example, the signal electrode drive circuit means 203 that each drives a signal electrode and the scanning electrode driving circuits 204 that each drives a scanning electrode, the liquid-crystal display drive circuit 200 according to the present invention is capable of directly inputting a signal (sign) from an external system to the scanning electrode driving circuits 204 to drive them by using the voltage swinging method.

That is, in a liquid-crystal drive circuit 200 which is formed by a liquid crystal display means 202, the signal electrode driving means 203 which drives a plurality of signal electrodes and which are connected to the liquid-crystal display means 202, and the scanning electrode driving circuits 204 which drives a plurality of scanning electrodes and which are connected to the liquid-crystal driving means 202, the liquid-crystal drive circuit 200 is configured so that, when driving a specific scanning electrode driving circuits 204 of the above-noted driving means using the voltage swinging method, the liquid-crystal display drive circuit 200 according to the present invention is configured so as to directly input an input signal (sign) from an external system to the above-noted scanning electrode driving circuits 204.

That is, a specific configuration of a liquid-crystal display drive circuit 200 according to the present invention is shown in FIG. 3, in which drawing the liquid-crystal driving circuit 200 is formed from the signal electrode driving means 203 which drives the signal electrodes of the liquid-crystal display means 202 and the scanning electrode driving circuits 204 which drives the scanning electrodes provided in a direction that perpendicularly intersects these signal electrode driving circuits, and in particular this liquid-crystal driving circuit 200 has a swinging voltage generating circuit 206 that generates a swinging voltage with respect to the above-noted scanning electrode driving circuits 204, an appropriate signal input means 208 which applies a prescribed signal to the above-noted scanning electrode driving circuits 204, and a controller 205 that separately controls the above-noted signal electrode driving means 203, the above-noted swinging voltage generating circuit 206, and the above-noted scanning electrode driving circuits 204.

Thus, in the present invention, within the above-noted scanning electrode driving circuits 204, a signal level converting means 100 is provided which converts an input signal from an external signal (sign), which is applied to the above-noted scanning electrode driving circuits 204 via the appropriate signal input means 208, to a prescribed level.

Next, by way of description of the configuration of the signal level converting means 100 that is part of the liquid-crystal display driver 200 according to the present invention, it is desirable that this signal level converting means 100 have a circuit configuration such as described below.

Specifically, the above-noted signal level converting means 100 is desirably configured so as to have a function which converts the high-level potential and the low-level potential of an input signal from an external system to a high-level potential and a ground potential of a scanning drive voltage that drives the above-noted scanning electrode driving circuits 204.

Figure 1:
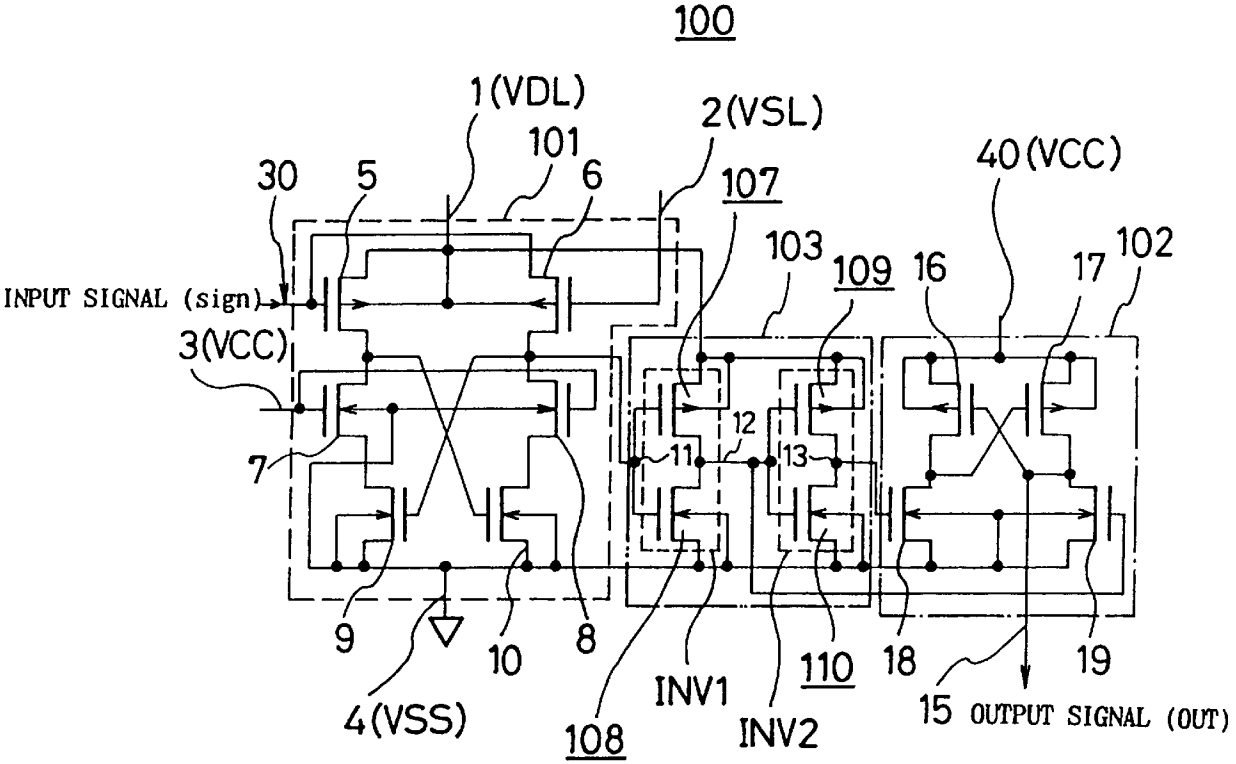
FIG. 1 is a drawing which shows the circuit configuration in an embodiment of the present invention.

Additionally, as a more specific description of the configuration of the above-noted signal level converting means 100 in a liquid-crystal display driver 200 according to the present invention, this signal level converting means 100 according to the present invention is preferably configured so as to have, as shown in FIG. 1, a signal input section 101, an output signal section 102, and an inverting means 103 which is connected to the signal input section 101 and the output signal section 102.

More specifically, for example, the above-noted signal input section 101 has a signal inputting means 30, a first inputting means 1 which inputs a high-level potential (VDL) of an input signal from an external system, a second inputting means 2 which inputs a low-level potential signal (VSL) of an input signal from an external system, a third inputting means 3 which is connected to a power supply potential (VCC) having a low withstand voltage within the scanning electrode driver, and a first connecting means 4 which is connected to a ground potential (VSS) within the scanning electrode driver.

Yet more specifically, with regard to the above-noted signal input section 101, this signal input section has a first MOSFET 5 of a first conduction type, the gate of which is connected to the above-noted signal inputting means 30 and the source of which is connected to a first input 1, a second MOSFET 6 of the first conduction type, the gate of which is connected to the above-noted second inputting means 2 and the source of which is connected to the above-noted signal inputting means 30, and which has a back gate that is in common with the above-noted first MOSFET 5 that is connected to the above-noted first inputting means 1, a third MOSFET 7 of a second conduction type, having a source which is connected to the drain of the above-noted first MOSFET 5 and having a gate that is connected to the above-noted third inputting means 3, a fourth MOSFET 8 of the second conduction type, having a source that is connected to the drain of the above-noted second MOSFET 6, having a gate that is connected to the above-noted third inputting means 3, and having a back gate that is in common with the above-noted third MOSFET 7 which is connected to the above-noted first connecting means 4, a fifth MOSFET 9 of the second conduction type, having a source that is connected to the drain of the above-noted third MOSFET 7, having a drain that is connected to the above-noted first connecting means 4, and having a gate that is connected to the drain of the second MOSFET 6, and a sixth MOSFET 10 of the second conduction type, having a source that is connected to the drain of the above-noted fourth MOSFET 8, having a drain that is connected to the above-noted first connecting means 4, and having a gate that is connected to the drain of the first MOSFET 5.

Additionally, the above-noted first inputting means 1 is connected to the power supply input section of the inverting means 103 which is configured in two stages, and the drain of the above-noted second MOSFET 6 is connected to the inputting means 11 of the first stage inverter INV1 in this inverting means 103.

The above-noted output signal section 102 is formed by a seventh MOSFET 16 and an eight MOSFET 17 of the first conduction type, the sources of which are connected to a power supply potential 40 (VCC) having a low withstand voltage within the above-noted scanning electrode driver, a ninth MOSFET 18 of the second conduction type, the source of which is connected to the drain of the seventh MOSFET 16 and also connected to the gate of the eight MOSFET 17, the drain of which is connected to the above-noted first connecting means 4, and the gate of which is connected to an outputting means 13 of the second stage inverting means INV2, a tenth MOSFET 19 of the second conduction type, the source of which is connected to the drain of the eight MOSFET 17 and also connected to the gate of the seventh MOSFET 16, the drain of which is connected to the first connecting means 4 and the gate of which is connected to the outputting means 12 of the first stage inverting means INV1, and an outputting means 15 which is provided at the source of the tenth MOSFET 19.

In above example of the present invention, the first stage inverting means INV1 is configured, for example, by a PMOSFET 107 and an NMOSFET 108, and the second stage inverting means INV2 is configured, for example, by a PMOSFET 109 and an NMOSFET 110.

Next, the operation and signal conversion processing method in the above-described example of a liquid-crystal display driving circuit according to the present invention will be described in detail.

Specifically, FIG. 1 is a drawing for the purpose of showing the circuit configuration for implementing the according to the present invention.

In this drawing, the reference numerals 5, 6, 107, and 109 indicate high withstand voltage PMOS devices, 7, 8, 9, 10, 108, 110, 18, and 19 indicated high withstand voltage NMOS devices, and 16 and 17 indicate low withstand voltage PMOS devices.

The power supply potentials input to the scanning electrode driver shown in FIG. 1 are indicated in FIG. 2(A)

Figure 2:
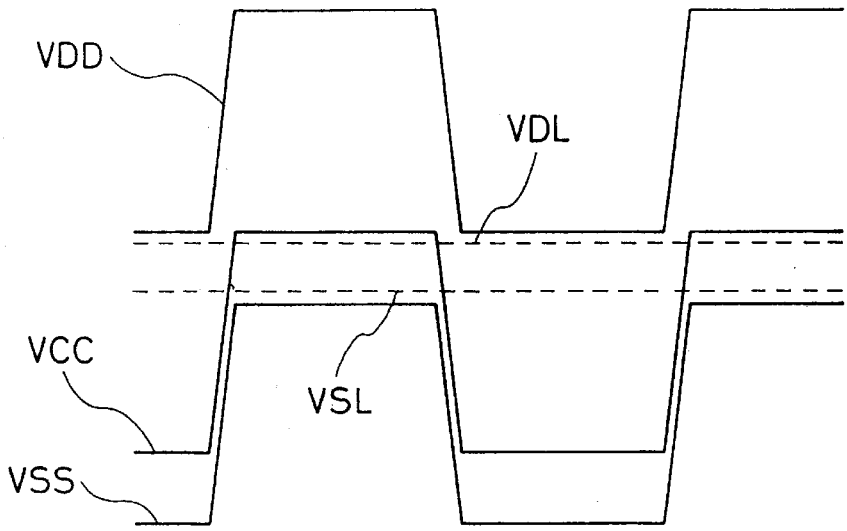
FIG. 2(A) is a drawing which shows the power supply potential in the voltage swinging method in an embodiment of the present invention.
FIG. 2(B) is a drawing which shows the input signal voltage level with respect to the power supply potential in the voltage swinging method in an embodiment of the present invention.
Figure 2:
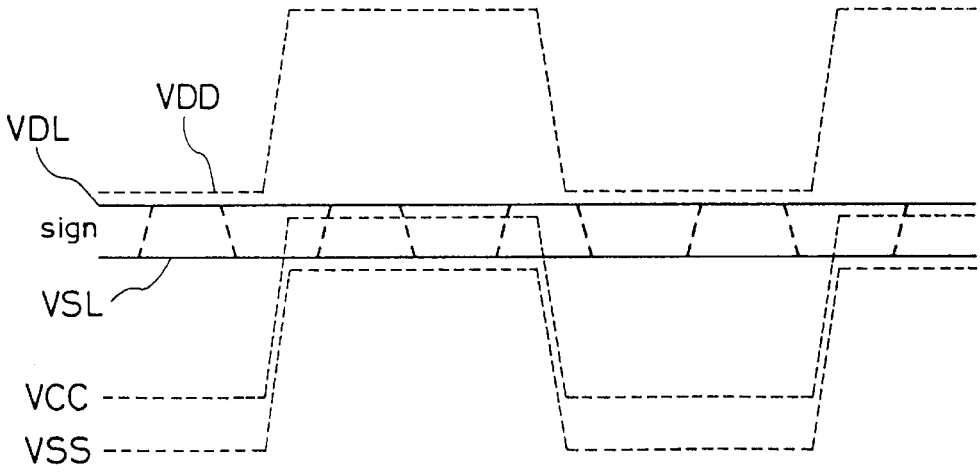

By way of description of the potentials shows in FIG. 2, VDD is a high withstand voltage power supply potential within the scanning electrode driver, VCC is the low withstand voltage power supply potential within the scanning electrode driver, VSS is the ground potential within the scanning electrode driver, VDL is the high-level potential of an input signal from an external system, and VSL is the low-level potential of an input signal from an external signal, this being the external system ground potential.

The operation of the circuit which is shown in FIG. 1 will now be described.

First, we will consider the case in which the input signal is at the high level, that is, when the input signal is VDL. When VDL is input, the PMOS device 5 is off, and the PMOS device 6 is on.

When this happens, the gate of the NMOS device 9 has VDL applied to it, this causing the NMOS device 9 to turn on, with the NMOS device 7 also being turned on, the result being that the gate of the NMOS device 8 has VSS applied to it, this causing shutoff of the NMOS device 8.

As a result, the gates of the first inverter stage INV1 which is formed by the PMOS device 107 and the NMOS device 108 have VDL applied to them, this causing VSS to be output from the output of the first inverter stage INV1.

The gates of the subsequent second inverter stage INV2, which is formed by the PMOS device 109 and the NMOS device 110, have VSS applied to them from the proceeding inverter output, so that VDL is output from this second inverter stage INV2.

While the PMOS device 6 and the NMOS device 8 are each in the on condition, because the NMOS device 9 and the PMOS device 5 which are respectively connected in series therewith are off, unless the input signal changes, current does not flow, thereby enabling a reduction of wasteful power consumption.

The output of the first inverter stage INV1, which is formed by the PMOS device 107 and the NMOS device 108 is the gate input of the NMOS device 19, this causing the NMOS device 19 to be switched off.

The output of the second inverter stage INV2, which is formed by the PMOS device 109 and the NMOS device 5 is the gate input to the NMOS device 18, which causes this NMOS device 18 to be on.

Because the NMOS device 18 is on, the gate of the PMOS device 17 has VSS applied to it, this causing the PMOS device 17 to be switched on.

When the PMOS device 17 is switched on, the gate of the PMOS device 16 has VCC applied to it, this causing the PMOS device 16 to be off.

As a result, VCC is output as the output signal. That is, the output is the high level of the potential level within the scanning electrode driver is output.

Next, consider the case in which the input signal is a low level, that is, the case in which VSL is input. When VSL is input, the PMOS device 101 is turned on, and the PMOS device 6 is turned off.

When this occurs, the gate of the NMOS device 10 has VDL applied to it, so that the NMOS device 10 is turned on.

When this happens, the NMOS device 8 also is turned on, so that the gate of the NMOS device 9 has VSS applied to it, this causing shutoff of the NMOS device 9.

As a result, VSS is applied to the gates of the inverter that is formed by the PMOS device 107 and the NMOS device 108, the output of this inverter thereby being made VDL. The gates of the subsequent inverter which is formed by the PMOS device 109 and the NMOS device 110 have VDL applied to them from the output of the previous inverter, and VSS is output.

The output of the inverter that is formed by the PMOS device 107 and the NMOS device 108 is the gate input of the NMOS device 19. The output of the inverter that is formed by the PMOS device 109 and the NMOS device 110 is the gate input of the NMOS device 18, so that the NMOS device 18 is turned off.

Because the NMOS device 19 is on, VSS is applied to the gate of the PMOS device 16, this causing the PMOS device 16 to be turned on.

When the PMOS device 16 is turned on, VCC is applied to the gate of the PMOS device 17, this causing the PMOS device 17 to be turned off.

As a result, the output signal is VSS. That is, the output is the low level in the potential level within the scanning electrode driver.

As noted in the above operational description, when the input signal is VDL, level conversion is performed by the circuit of FIG. 1, thereby causing a shift to VCC. That is, there is a conversion to a high-level signal for low-voltage logic within the scanning electrode driver.

In the same manner, when the input signal is VSL, level conversion is performed by the circuit of FIG. 1, thereby causing a shift to VSS. This represents a conversion to the low-level signal for low-voltage logic within the scanning electrode driver.

Because it is possible to automatically convert the above-described input signal (sign) to low-level voltages used with the scanning electrode driving circuits, as shown in FIG. 2(B), it is possible to directly apply the input signal to the scanning electrode driving circuits, without providing a special level converting means.

Therefore, in subsequent circuits which do not need to have high withstand voltages, the need to use high-voltage MOS devices is eliminated, this making it possible to perform signal processing entirely with low-voltage MOS devices.

For this reason, it is possible to reduce the chip surface area, and also possible to achieve a savings in power consumption.

As is clear from the specific example noted above, in the present invention it is desirable that the method of driving the liquid-crystal display be as follows.

Specifically, in a liquid-crystal display drive circuit 200 having a plurality of signal electrode driving means 203 which each drives a signal electrode and a plurality of scanning electrode driving circuits 204 which each drives a scanning electrode, this method is that of performing drive by directly inputting an input signal from an external system to the scanning electrode driving circuits 204 which is driven by the voltage swinging method, and this method is desirably configured so that, in a liquid-crystal display 200 which is formed by a liquid-crystal display means 200, a plurality of signal electrode driving means 203 which each drives a signal electrode, and a plurality of scanning electrode driving circuits which each drives a scanning electrode, when performing drive of the scanning electrode driving circuits 204 using the voltage swinging method, conversion is made to low-voltage logic levels used within the scanning electrode driving circuits 204.

In a liquid-crystal display driving circuit according to the present invention, by virtue of the above-described technical constitution, using the voltage swinging method it is possible by performing input of a signal without external level conversion, thereby simplifying external circuitry. Additionally, because it is possible to configure the circuit using low-voltage MOS devices rather than the high-voltage MOS devices which have usually been used and also because it is possible to perform operation with low voltage that was previously done with high voltage, it is possible to achieve the effect of a reduction in power consumption.

What is claimed is:

1. A liquid-crystal display drive circuit comprising:

a plurality of signal electrodes;

a signal electrode driving circuit for driving the plurality of signal electrodes;

a plurality of scanning electrodes;

a scanning electrode driving circuit for driving the plurality of scanning electrodes;

a voltage swinging drive circuit, said liquid-crystal display driving circuit being capable of direct input of an input signal from an external system to said scanning electrode driving circuit the scanning electrode driving circuit being driven by said voltage swinging drive circuit, and within said scanning electrode driving circuit a signal level converting means is located for converting a signal level of an input signal input from an external system, wherein said signal level converting means comprises a signal input section, a signal output section, and an inverter means which is connected to said signal input section and said output signal section, said signal input section comprising:

a signal input means;

a first inputting means which inputs a high-level potential {VDL) of an input signal from an external system;

a second inputting means which inputs a low-level potential signal {VSL) of an input signal from an external system;

a third inputting means which is connected to a power supply potential (VCC) having a low withstand voltage within said scanning electrode driver; and a first connecting means which is connected to a ground potential (VSS) within said scanning electrode driver, wherein said signal input means further comprising:

a first MOSFET of a first conduction type, the gate of which is connected to said signal inputting means and the source of which is connected to a first inputting means;

a second MOSFET of said first conduction type, the gate of which is connected to said second inputting means and the source of which is connected to said signal inputting means, and which has a back gate that is in common with said first MOSFET that is connected to said first inputting means;

a third MOSFET of a second conduction type, having a source which is connected to the drain of said first MOSFET and having a gate that is connected to said third inputting means;

a fourth MOSFET of said second conduction type, having a source that is connected to said drain of said second MOSFET, having a gate that is connected to said third inputting means, and having a back gate that is in common with said third MOSFET which is connected to said first connecting means, a fifth MOSFET of said second conduction type, having a source that is connected to said drain of said third MOSFET, having a drain that is connected to said first connecting means, and having a gate that is connected to said drain of said second MOSFET; and a sixth MOSFET of said second conduction type, having a source that is connected to said drain of said fourth MOSFET, having a drain that is connected to said first connecting means, and having a gate that is connected to said drain of said first MOSFET, and further wherein, said first inputting means being connected to the power supply input section of said inverting means which is configured in two stages, and said drain of said second MOSFET is connected to said inputting means of the first stage inverter INV1 in this inverting means, and wherein, said output signal section comprising:

a seventh MOSFET and an eighth MOSFET of said fist conduction type, the sources of which are connected to a power supply potential (VCC) having a low withstand voltage within said scanning electrode driver;

a ninth MOSFET of said second conduction type, the source of which is connected to the drain of the seventh MOSFET and also connected to the gate of said eighth MOSFET, the drain of which is connected to said first connecting means, and the gate of which is connected to an outputting means of said second stage inverting means;

a tenth MOSFET of said second conduction type, the source of which is connected to the drain of said eighth MOSFET and also connected to said gate of said seventh MOSFET, the drain of which is connected to said first connecting means and the gate of which is connected to the outputting means of said first stage inverting means; and an outputting means which is provided at the source of said tenth MOSFET.

* * * * *